US006452491B1

(12) United States Patent
Maier, Jr. et al.

(10) Patent No.: US 6,452,491 B1
(45) Date of Patent: Sep. 17, 2002

(54) AMPLIFIER AND HEAT SINK CONFIGURATION

(75) Inventors: Paul H. Maier, Jr., Athol, MA (US); Patrick Joyce, Keene, NH (US)

(73) Assignee: SimplexGrinnell LP, Westminster, MA (US)

( * ) Notice: Subject to any disclaimer, the term of this patent is extended or adjusted under 35 U.S.C. 154(b) by 0 days.

(21) Appl. No.: 09/843,535

(22) Filed: Apr. 25, 2001

(51) Int. Cl.[7] ..... G08B 29/00

(52) U.S. Cl. ..... 340/506; 340/584; 340/540; 340/693.2; 340/664; 361/704; 361/600; 330/295; 330/297

(58) Field of Search ..... 340/506, 584, 340/540, 512, 513, 508, 509, 693.2, 333, 664, 384.7, 384.71, 384.72; 361/704, 600, 709; 381/56, 58; 372/36; 330/124 R, 295, 297, 298

(56) References Cited

U.S. PATENT DOCUMENTS

| | | | | | |
|---|---|---|---|---|---|
| 3,581,221 | A | * | 5/1971 | Martin | 330/289 |
| 4,218,660 | A | * | 8/1980 | Carver | 330/297 |
| 4,268,887 | A | * | 5/1981 | Ghiringelli et al. | 330/143 |
| 4,375,637 | A | * | 3/1983 | Desjardins | 340/517 |
| 4,378,530 | A | * | 3/1983 | Garde | 330/267 |
| 4,779,060 | A | | 10/1988 | Henden | 330/277 |
| 4,901,085 | A | | 2/1990 | Spring et al. | 342/373 |
| 4,939,786 | A | * | 7/1990 | McCallum et al. | 340/584 |
| 5,055,798 | A | | 10/1991 | Heinzelmann | 330/295 |
| 5,111,166 | A | | 5/1992 | Plonka et al. | 333/128 |
| 5,438,684 | A | | 8/1995 | Schwent et al. | 455/89 |
| 5,751,250 | A | | 5/1998 | Arntz | 342/373 |
| 5,818,388 | A | | 10/1998 | Lane et al. | 342/373 |
| 5,854,611 | A | | 12/1998 | Gans et al. | 342/373 |
| 5,892,404 | A | * | 4/1999 | Tang | 330/297 |
| 5,945,815 | A | | 8/1999 | Elliott | 323/269 |
| 5,966,002 | A | | 10/1999 | Barrieau et al. | 323/222 |

* cited by examiner

*Primary Examiner*—Jeffery Hofsass
*Assistant Examiner*—Daniel Previl
(74) *Attorney, Agent, or Firm*—Hamilton Brook Smith & Reynolds, P.C.

(57) ABSTRACT

An amplifier assembly includes a heat sink and a plurality of amplifier stages, where the total power rating of the amplifier stages is greater than the power rating of the heat sink. The heat sink can have a power rating of 50 watts and can include two amplifier stages, each having a power rating of 50 watts. In an alarm system, each amplifier is able to power one or more selected alarm loops. One of the plurality of amplifier stages acts as a backup amplifier for any of the other amplifier stages in the event of an amplifier stage failure. Also, the amount of power produced by the amplifier stages is flexibly controlled by the alarm system.

15 Claims, 3 Drawing Sheets

AMPLIFIER AND HEAT SINK CONFIGURATION

BACKGROUND OF THE INVENTION

In present audio fire alarm systems, it is common to find systems that are not able to effectively utilize the power of a given size amplifier. Because of this, different manufacturers have provided fire alarm systems having various amplifier sizes, all in an attempt to find the optimal power density for a typical fire alarm application. In addition, the requirement for backup amplification in a fire alarm system often requires additional, unused amplifiers to be installed as a means of providing that backup. Both of these limitations add to the equipment cost of a typical alarm system installation.

FIG. 1 illustrates a prior art amplifier assembly, given generally as 10. The assembly 10 includes a plurality of heat sinks 14 having a plurality of amplifiers 12 mounted to each heat sink 14. Generally, the amplifier assembly 10 includes two heat sinks 14, each heat sink having two amplifiers 12 mounted thereon.

In one prior art amplifier assembly 10, two 25-watt audio amplifiers 12 are packaged onto a single 50-watt rated heat sink14. Each amplifier 12 serves a particular zone in a fire alarm system to provide audible messages during an alarm situation. In a system with three zones, for example, the amplifier assembly 10 includes two dual packages, each dual package having one heat sink 14 with the amplifiers 12 as shown in FIG. 1. Three of the amplifiers 12 are used to provide power to the three zones while the fourth amplifier within the two packages serves as a backup that can be switched over to any of the three zones in the event of failure of one of the first three audio amplifiers. Typically, each floor or zone requires about 15 watts which can be served by an individual 25-watt amplifier.

SUMMARY OF THE INVENTION

A disadvantage of the amplifier assembly 10 having two heat sinks 14, with each heat sink having two amplifiers 12, is the cost involved in manufacturing such an assembly. With a relatively high number of components within the assembly 10, the cost of manufacturing the amplifier assembly 10 is also relatively high.

In order to overcome the relatively high cost of manufacturing an amplifier assembly with multiple heat sinks and multiple amplifiers on each heat sink, an amplifier assembly can be manufactured having a single heat sink with a plurality of amplifier stages mounted to the heat sink. The amplifier assembly includes a heat sink and a plurality of amplifier stages mounted to the heat sink. The heat sink includes a heat sink power rating and each amplifier stage has a power rating. The power rating of each amplifier stage is approximately equal to the power rating of the heat sink. The combination of the plurality of amplifier stage power ratings yields a total power rating greater than the heat sink power rating.

The plurality of amplifier stages includes a first amplifier stage and a second amplifier stage. The heat sink has a power rating of 50 watts while the first amplifier stage and the second amplifier stage each have a power rating of 50 watts.

Power is provided from the amplifier assembly by adjusting the power level of the first amplifier stage and the second amplifier stage such that the total resulting power level of the combination of the first amplifier stage and the second amplifier stage is less than the heat sink power rating.

The amplifier assembly can be formed as part of an alarm system that includes a plurality of alarms. The alarm system includes a plurality of detector loops, each detector loop having at least one alarm or detector. Each detector loop is located within in a zone.

As part of the alarm system, the amplifier assembly provides backup audio power to the alarm system. The alarm system includes an amplifier assembly connected to a plurality of alarms located in a plurality of zones. At least one of the amplifier stages in the amplifier assembly powers an audio signal for the plurality of alarms. When an amplifier stage power failure is detected, the power source is switched from the first of a plurality of amplifier stages to a second amplifier stage. The audio signal is thereby powered for the plurality of alarms using the second amplifier stage.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
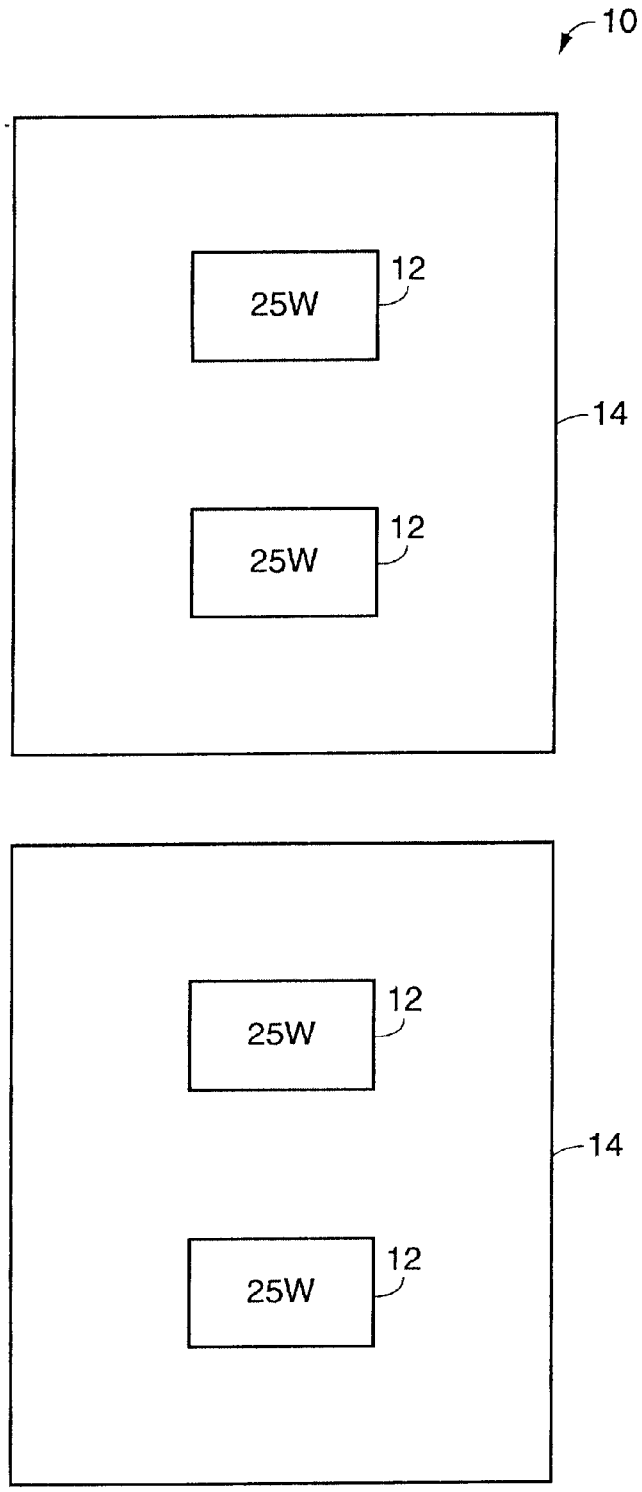
Figure 1 PRIOR ART
FIG. 1 illustrates a prior art amplifier assembly.
Figure 2:
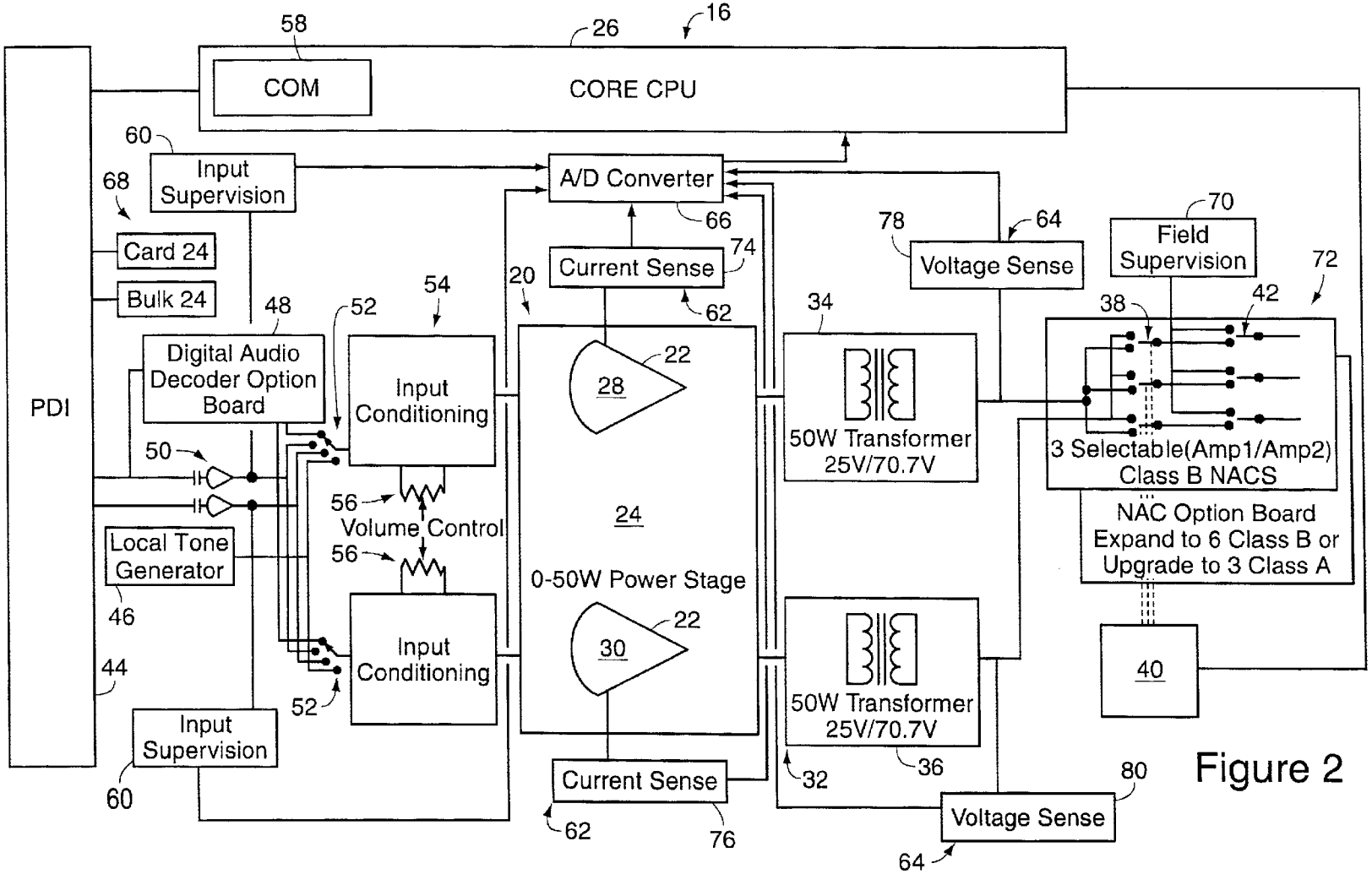
FIG. 2 illustrates an amplifier assembly mounted within an alarm system.

FIG. 2 illustrates an amplifier assembly 20 having a heat sink 24 with a plurality of amplifier stages 22 mounted on the heat sink 24. The amplifier assembly 20 allows for redundancy in the use of multiple amplifier stages on a single heat sink 24. In a preferred embodiment, the heat sink 24 includes two amplifier stages 22, a first amplifier stage 28 and a second amplifier stage 30.

Each amplifier stage 22 has a power rating and the heat sink 24 has a power rating. Preferably, the first amplifier stage 28 and the second amplifier stage 30 each have a power rating of 50 watts and the heat sink 24 has a power rating of 50 watts. The power rating of each amplifier stage 30 is approximately equal to the power rating of the heat sink 24. The total power rating of the amplifier 22 which is the combined power rating of each of the amplifier stages 22, is greater than the power rating of the heat sink 24. For example, with two 50-watt amplifiers 28, 30 provided on a single 50-watt heat sink 24, the total power rating for the amplifier stage 22 equals 100 watts, while the power rating for the heat sink is 50 watts. As shown, the total power rating for the amplifier 22 is greater than the power rating of the heat sink 24.

Because of the limitation of the power rating of the heat sink 24 with respect to that of the amplifiers 22, the two amplifiers cannot simultaneously operate at full power, but can be operated in any combination that provides a total of 50 watts. For example, one amplifier typically serves two floors for a total of 30 watts and the other amplifier serves a third floor at 15 watts. If either amplifier failed, a single amplifier can handle all three floors at 45 watts. In each situation, no more than 50 watts is used by the system, to prevent overload of the heat sink 24.

The amplifier assembly 20 is formed as part of an alarm system 16, such as is used in fire detection. The alarm system 16 includes a central processing unit (CPU) 26 which is connected to an audio signal generator 44, such as a power distribution interface (PDI). The CPU can include a communication port 58 to provide data communication between the CPU 26 and the audio signal generator 44. The communication port 58 can be a serial communication port, for example. The audio signal generator 44 is powered from a plurality of power sources 68.

The audio signal generated by the audio signal generator 44 can either be a digital signal or an analog signal. The audio signal can include an audio tone or a verbal message, for example. When the signal is a digital audio signal, the digital audio signal is processed by a digital audio decoder 48. The decoder 48 converts the digital audio signal into an analog audio signal prior to distribution to the amplifier assembly 20. When an analog signal is produced by the audio signal generator 44, the analog signal is sent to pre-amplifiers 50 prior to distribution to the amplifier assembly 20. The pre-amplifier 50 acts to provide a boost in the signal prior to amplification by the amplifier assembly 20. In a preferred embodiment, the alarm system 16 includes two pre-amplifiers 50 that allow pre-amplification of a signal for each of the two amplifier stages 22.

The pre-amplified signal generated by the pre-amplifiers 50 is supervised by a signal sensor 60. In a preferred embodiment, there are two signal sensors 60 in the system, each being connected to the output of each pre-amplifier 50. The signal sensor 60 is used to detect the presence of an analog signal produced by the pre-amplifiers 50. The signal sensor 60 includes a feedback loop to an analog-to-digital converter 66 which in turn has a connection to the CPU 26. The feedback loop provides data relating to the presence or absence of an audio signal to the CPU 26 for processing. In fire alarm systems, signal sensors 60 are required as part of the system to ensure the presence of an audio signal for an alarm.

The alarm system 16 can also include a tone generator 46 separate from the audio signal generator 44. The tone generator 46 also generates an audio signal, such as an audio tone, for distribution through the alarm system 16. The tone generator 46 provides redundancy in the alarm system 16 in the event of failure of the audio signal generator 44. The alarm system 16 also includes a plurality of audio input switches 52. Preferably, there are two switches 52 in the system 16 that correspond to the respective two amplifier stages 22. The audio input switch allows a user to select an audio source to connect with an amplifier stage 22. For example, the switch 52 can allow the first amplifier stage 28 to receive an audio signal from the digital audio decoder 48, either of the two pre-amplifiers 50 or the local tone generator 46.

Each switch 52 allows passage of the audio signal to a signal conditioner 54. Preferably, the signal conditioner 54 is a low pass filter. The signal conditioner 54 can include a volume control 56 to adjust the output level of the signal. Preferably, there are two signal conditioners 54 in the alarm system 16, a first connected to the first amplifier stage 28 and a second connected to the second amplifier stage 30. Each amplifier stage 22 amplifies the audio signal provided from the signal conditioners 54.

The alarm system 16 also includes a current sensor 62 electrically connected to each amplifier stage 22. Preferably, the alarm system assembly 16 includes two current sensors 62, one current sensor 74 electrically connected to the first amplifier stage 28 and a second current sensor 76 attached to a second amplifier stage 30. The current sensor 62 measures the amount of current drawn by each amplifier stage 22. The current sensor 62 includes a feedback loop to the A/D converter 66. The feedback loop allows the measurement data to be sent from the sensor 62 to the A/D converter 66 for conversion from an analog signal to a digital signal. The signal is further sent to the CPU 26 which then processes the information relating to the current drawn by the amplifier stage 22.

After amplification by each amplifier stage 22, the audio signal is sent to a transformer 32. Preferably, there are two transformers in the alarm system 16, a first transformer 34 and a second transformer 36 wherein each transformer 34, 36 is attached to a single amplifier stage 28, 30. The transformer 32 couples the amplifier stages 22 to loudspeakers within the alarm system 16. The transformers 32 are used to boost the voltage of the audio signals coming from the amplifier stages 22.

The alarm system assembly 16 also includes a plurality of voltage sensors 64. Preferably, there are two voltage sensors 64 within the alarm system assembly 16, a first 78 coupled after the first transformer 34 and a second 80 coupled after the second transformer 36. The voltage sensor 64 detects the presence of an audio signal in the form of a voltage coming from the power stages 22. The voltage sensors 64 also include a feedback loop to the AID converter 66. The voltage measurement taken by the voltage sensor 64 is sent by the feedback loop to the AD converter 66 which is then sent into the CPU 26 for further processing.

The alarm system assembly 16 also includes a switching assembly 72. The switching assembly 72 has a plurality of zone selections switches 38 that provide connection between the amplifier stages 22 and a plurality of zones connected to the alarm system assembly 16. Each zone includes a plurality of speakers. In the case where the alarm system assembly 16 includes two amplifier stages 22, the zone selection switches allow selection of either the first amplifier stage 28, the second amplifier stage 30 or some combination of the two to power the zones connected to the alarm system 16. For example, when the switches 38 are in a first position, an audio signal amplified by the second amplifier stage 30 is provided to all of the zones connected to the alarm system 16. When the switches 38 are in a second position, an audio signal amplified by the first amplifier stage 28 is provided to all of the zones attached to the alarm system 16.

Each switch of the zone selection switches 38 operates independently of the other switches. This independence allows a combination of the amplifier stages 22 to power the zones. For example, the first amplifier stage 28 can power a signal for all three zones, any combination of two zones, a single zone, or no zones at all. The second amplifier stage 30 can similarly power all three zones, any combination of two zones, a single zone, or no zones at all.

Each switch of the zone selection switches 38 is connected to a switch controller 40. The controller 40 is in electrical communication with the CPU 26. Based upon the feedback from the current sensor 62 and the voltage sensor 64, the CPU 26 controls the positioning of the switches 38 to select the amplifier stage 22 or combination of stages 22 to power the zones. Alternately, the controller is in electrical communication with an external computer where the external computer controls positioning of the switches based on feedback from the current sensor 62 or the voltage sensor 64.3

The switching assembly 72 also includes a field supervision control 70 and a plurality of field supervision switches 42. Preferably, there are three field supervision switches 42 in the system 16 corresponding to the three zones, respectively. The field supervision control 70 determines the continuity of the wiring to each of the zones. The field supervision control 70 determines whether or not there is an open line or a short circuit within the zones. Positioning of the field supervision switches 42 in a first position allows for field supervision of the lines. Positioning of the field supervision switches 42 in a second position, allows the transfer of an audio signal from the amplifier stages 22 to the zones.

The zone selection switches 38 also allow one of the amplifier stages 22 to act as a built in backup amplifier for the alarm system 16. For example, the second amplifier stage 30 acts as a built-in backup for the first amplifier stage 28. If the first stage amplifier 28 is used to amplify an audio signal for any one or more of the first, second and third zone and the first amplifier stage 28 were to fail, such failure can be detected by the first current sensor 74 and the first voltage sensor 78. This information is then sent to the CPU 26. The software in the CPU 26 causes the switches 38 of the switching assembly 72 to change positions by way of the controller 40, such that the second amplifier stage 30 is used to amplify the audio signal and provide signal to all three zones.

As mentioned above, the total power rating for the combination of each of the plurality of amplifiers stages 22 is such that the total is greater than the heat sink power rating. In operation, however, the total power output of the amplifier stages 22 is less than or equal to the power rating of the heat sink 24. Therefore, each of the two power stages can individually provide up to the full assembly rating of 50 watts while the combination of the two stages should not exceed the assembly rating of 50 watts. For example, in the case where the heat sink 24 power rating is 50 watts and the first amplifier stage provides power in the amount of 20 watts, the second amplifier stage 30 can provide power in an amount not greater than 30 watts. In this situation, the combined power output of the amplifier stages 22 is equal to 50 watts, which is equivalent to the power rating of the heat sink 24.

The amount of power produced by the amplifier stages 22 is controlled by the loudspeakers in the zones connected to the alarm system assembly 16. Each zone includes a plurality of speakers. The flexible allocation of power among the amplifier stages 22 is based upon the design of the alarm system 16. The plurality of speakers within the zones place a load on the amplifier stages 22 and the amount of power drawn from the amplifier stages 22 depends on the number of speakers or loads present in the system. For example, two one-watt speakers requires a combined power draw of less than 50 watts. Therefore, an amplifier stage 22 attached to the speakers, in this example, would produce less than 50 watts of power. The alarm system 16 can therefore be designed such that the amount of power needed to be produced by either stage is less than 50 watts.

The alarm system 16 can also be designed such that the total amount of power needed to drive the speakers in the alarm system 16 is not greater than 50 watts. For example, in the case where an amplifier stage 22 fails and a second or backup amplifier stage 22 is used to power the audio signal for the system, the single amplifier stage can produce the maximum of 50 watts to drive the speakers while being within the power rating of the heat sink 24. If the amplifier stage were to exceed the heat sink power rating, the system could fail or the amplifier could shut down.

Figure 3:
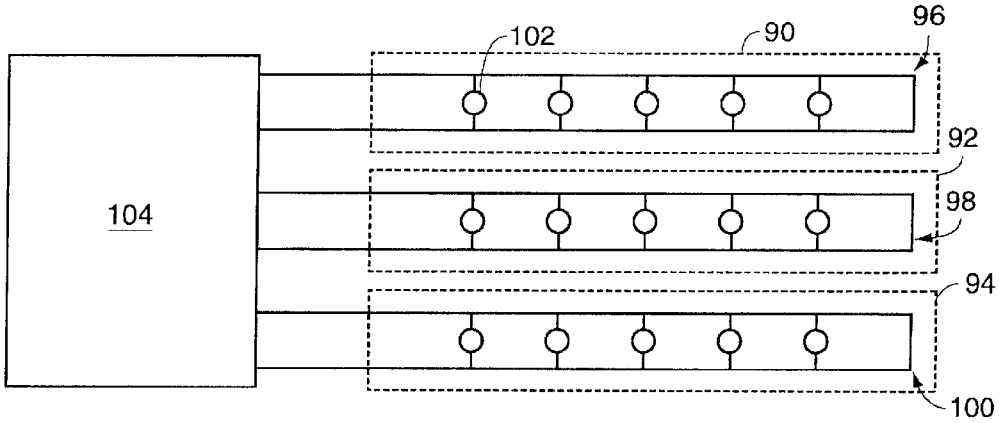
FIG. 3 illustrates detector loops for several zones.

The alarm system includes a plurality of detector loops. Each zone includes a separate detector loop, as shown in FIG. 3. For example, a first zone 90, a second zone 92 and a third zone 94 include a first detector loop 96, a second detector loop 98 and a third detector loop 100, respectively. Each detector loop includes at least one detector 102. The detector loop for each zone carries a signal from the detectors 102 to the CPU 26, located in a control panel 104, indicating the presence of an alarm condition. In the case of an alarm condition, the CPU 26 can activate the audio signal generator 44 to produce an audio signal that can travel through the alarm system 16, as described.

While this invention has been particularly shown and described with references to preferred embodiments thereof, it will be understood by those skilled in the art that various changes in form and details may be made therein without departing from the scope of the invention encompassed by the appended claims.

What is claimed is:

1. An amplifier assembly comprising:

a heat sink having a heat sink power rating; and a plurality of amplifier stages, each amplifier stage mounted to the heat sink and each amplifier stage having a power rating such that the combination of the plurality of power ratings yields a total power rating greater than the heat sink power rating.

2. The amplifier assembly of claim 1 wherein the plurality of amplifier stages comprises a first amplifier stage and a second amplifier stage.

3. The amplifier assembly of claim 2 wherein the heat sink comprises a power rating of 50 watts.

4. The amplifier assembly of claim 3 wherein the first amplifier stage comprises a power rating of 50 watts.

5. The amplifier assembly of claim 4 wherein the second amplifier stage comprises a power rating of 50 watts.

6. The amplifier assembly of claim 1 wherein the power rating of each amplifier stage is approximately equal to the power rating of the heat sink.

7. An alarm system comprising:

a plurality of alarms and;

an amplifier assembly electrically connected to the plurality of alarms, the assembly having a heat sink with a heat sink power rating and the assembly having a plurality of amplifier stages, each amplifier stage mounted to the heat sink and each amplifier stage having a power rating such that the combination of the plurality of power ratings yields a total power rating greater than the heat sink power rating.

8. The alarm system of claim 7 wherein the plurality of amplifier stages comprises a first amplifier stage and a second amplifier stage.

9. The alarm system of claim 7 wherein the heat sink comprises a power rating of 50 watts.

10. The alarm system of claim 9 wherein the first amplifier stage comprises a power rating of 50 watts.

11. The alarm system of claim 10 wherein the second amplifier stage comprises a power rating of 50 watts.

12. The alarm system of claim 7 wherein the power rating of each amplifier stage is approximately equal to the power rating of the heat sink.

13. The alarm system of claim 7 wherein the alarm system comprises a plurality of detector loops, each detector loop having at least one detector and each detector loop located in a zone.

14. A method for providing power comprising:

providing an amplifier assembly having a heat sink with a heat sink power rating and a plurality of amplifier stages mounted to the heat sink, each amplifier stage having a power rating, the combination of the plurality of power ratings yielding a total power rating greater than the heat sink power rating; and adjusting the power level of the first amplifier stage and the second amplifier stage such that the total resulting power level of the combination of the first amplifier stage and the second amplifier stage is less than the heat sink power rating.

15. A method for providing backup power to an alarm system comprising:

providing an amplifier assembly having a heat sink with a heat sink power rating and a plurality at amplifier stages mounted to the heat sink, each amplifier stage having a power rating, the combination of the plurality of power ratings yielding a total power rating greater than the heat sink power rating;

providing a plurality of alarms in a plurality of zones that form an alarm system;

connecting the amplifier assembly to the plurality of alarms; powering an audio signal for the plurality of alarms using at least one of the amplifier stages;

detecting an amplifier stage power failure;

switching a power source from the first amplifier stage to a second amplifier stage; and powering an audio signal for the plurality of alarms using the second amplifier stage.

* * * * *